US007249400B2

(12) United States Patent
Offa-Jones

(10) Patent No.: US 7,249,400 B2
(45) Date of Patent: Jul. 31, 2007

(54) RECLOSABLE FASTENERS FOR PLASTICS BAGS AND OTHER CONTAINERS

(75) Inventor: Martin John Charles Offa-Jones, North Yorkshire (GB)

(73) Assignee: Supreme Plastics Holding Ltd., London (GB)

( * ) Notice: Subject to any disclaimer, the term of this patent is extended or adjusted under 35 U.S.C. 154(b) by 0 days.

(21) Appl. No.: 10/070,937

(22) PCT Filed: Jul. 5, 2001

(86) PCT No.: PCT/GB01/02976

§ 371 (c)(1),
(2), (4) Date: Jun. 4, 2002

(87) PCT Pub. No.: WO02/04307

PCT Pub. Date: Jan. 17, 2002

(65) Prior Publication Data

US 2002/0162200 A1 Nov. 7, 2002

(30) Foreign Application Priority Data

Jul. 11, 2000 (GB) ..... 0016894.8

(51) Int. Cl.
*B65D 33/24* (2006.01)

(52) U.S. Cl. ..... 24/585.12

(58) Field of Classification Search ..... 24/30.5 R, 24/399, 400, 585.11, 585.12, 304, 693, DIG. 39, 24/DIG. 40, DIG. 50; 383/63–65, 61.2, 383/61.3; 156/66
See application file for complete search history.

(56) References Cited

U.S. PATENT DOCUMENTS

| | | | | | |
|---|---|---|---|---|---|
| 4,673,383 | A | | 6/1987 | Bentsen | 493/381 |
| 4,731,911 | A | | 3/1988 | Gould | 24/587 |
| 4,733,778 | A | * | 3/1988 | Boeckmann et al. | 206/714 |
| 4,817,188 | A | | 3/1989 | Van Erden | 383/63 |
| 5,216,787 | A | * | 6/1993 | Custer et al. | 24/585.12 |
| 5,242,516 | A | * | 9/1993 | Custer et al. | 156/66 |
| 5,566,429 | A | * | 10/1996 | Martinez et al. | 24/585.12 |
| 5,601,368 | A | * | 2/1997 | Bodolay et al. | 383/5 |
| 5,672,009 | A | | 9/1997 | Malin | 383/204 |
| 5,747,126 | A | * | 5/1998 | Van Erden et al. | 428/35.2 |
| 5,902,047 | A | * | 5/1999 | Yeager | 383/203 |
| 6,004,032 | A | * | 12/1999 | Kapperman et al. | 383/5 |
| 6,026,761 | A | * | 2/2000 | Parniske et al. | 114/343 |
| 6,154,934 | A | * | 12/2000 | Matthews | 24/585.1 |

* cited by examiner

*Primary Examiner*—James R. Brittain
(74) *Attorney, Agent, or Firm*—Woodcock Washburn LLP

(57) ABSTRACT

A reclosable fastener (10) comprising a male/female closure between a pair of opposed base members (18) has a single flange (16) for attachment of the closure to a web or film (34) on one only of the two base members. The fastener is attached initially to the film (34) by the single flange and then the fastener is additionally attached to the film (34) by heat and pressure applied in the region of attachment ribs (30) on the base members.

2 Claims, 1 Drawing Sheet

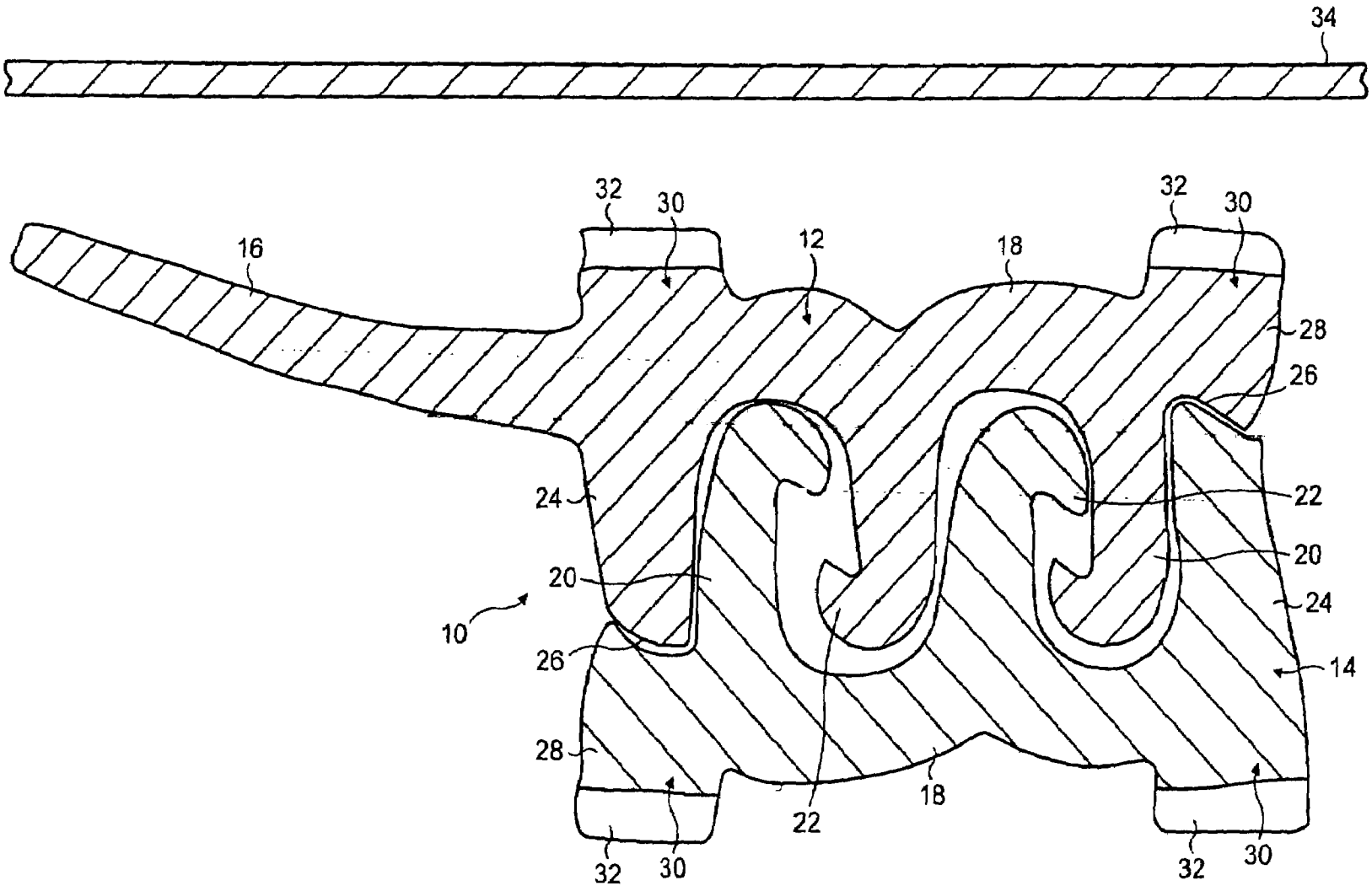
34
28
26
22
20
24
14
30
32
18
12
16
10

RECLOSABLE FASTENERS FOR PLASTICS BAGS AND OTHER CONTAINERS

FIELD OF THE INVENTION

This invention relates to reclosable fasteners, otherwise known as zippers, for plastics bags and other containers, and is particularly concerned with zippers intended to be applied to a film or web using cross-web techniques.

BACKGROUND TO THE INVENTION

When a zipper strip is applied to a film or web, heat and pressure are applied to effect the welding of the zipper to a film or web from which the bag or other container is to be made.

In order to secure the zipper to the film or web, the zipper is conventionally provided with a plurality of flanges on the two interengageable members which together make up the fastener. The most common practice is to provide four flanges, two on each member, in order to seal these flanges to film or web material on each side of the zipper. However, some zippers are provided with only three flanges, and some with only two. Sealing at the flanges is effected in order to keep heat and pressure away from the vulnerable male/female closure elements. However, it is a problem with such multi-flanged zippers that they tend to be bulky and do not easily deflect when used in cross-web procedures.

SUMMARY OF THE INVENTION

It is an object of the present invention to overcome this problem, by providing a zipper which is less bulky.

In accordance with the invention this is achieved by a reclosable fastener comprising a male/female closure between a pair of opposed base members, wherein a single flange for attachment of the closure to a web or film is provided on one only of the two base members.

The single flange is used to attach the zipper initially to the web or film for subsequent sealing/welding of the zipper to the web or film in the region of the base members, by whatever means is appropriate.

BRIEF DESCRIPTION OF THE DRAWING

In order that the invention may be more fully understood, one presently preferred embodiment of zipper in accordance with the invention will now be described by way of example and with reference to the accompanying drawing which is a schematic cross-sectional view through the zipper.

DESCRIPTION OF THE PREFERRED EMBODIMENT

Referring to the drawing, there is shown a zipper, indicated generally at 10, comprising a first element 12 and a second element 14. The two elements 12 and 14 are generally the same as each other, apart from the fact that element 12 is provided with a single elongate flange 16. Each element 12, 14 comprises a base member or body portion 18 with two upstanding legs 20 which terminate in hooks 22. The respective hooks 22 of the two elements 12 and 14 are interengageable to make the reclosable fastener.

Each element 12, 14 also comprises an upstanding support post 24 at one margin. The support post 24 is slightly longer than the hooked legs 20, 22 so that it extends slightly beyond the tops of the legs. The upper end surface 26 of each post 24 is tapered to provide an angled contact surface. Facing each support post 24, on the opposing element, there is provided a heel portion 28, again at the margin. The surface of each heel portion 28 facing the respective post 24 is shaped, i.e. angled, to be complementary to the angled contact surface 26. As can be seen from the drawing, with this arrangement, the respective posts and heels nest with one another to provide a shape-locking configuration which tends to resist squashing or outward bending under vertical loads. The angled contact surfaces are able to absorb the welding pressure and maintain their linear integrity, thus preventing the hooked legs 20, 22 from being squashed or distorted.

In order to reduce the effects of the welding heat, each of the closure elements 12 and 14 is provided with a pair of ribs 30 on the outside face remote from the legs 20. The respective ribs 30 are provided again at the margins of the closure, in alignment with the posts 24 and heel portions 28. The ribs 30 are provided by a thickening of the material of which each of the two elements is composed. Because of the additional bulk provided by the ribs 30, they also contribute to the resistance of the closure to deformation due to pressure. On each rib 30 there is provided a layer 32 of a material which is a high-performance sealing/welding material or blend of materials, such as EVA for example. This facilitates the welding of the zipper to the adjacent web or film 34. The layers 32 are co-extruded with the closure elements 12 and 14.

The single long flange 16 which is part of element 12 is arranged to face the inside of the bag or container. This single flange 16 is used for initial attachment to the film or web 34 as the zipper is applied to the web by a cross-web technique. The provision of a single long flange provides increased internal strength to the bag by altering the angle at which the load in the bag acts against the zipper closure. The flange 16 is attached to the web or film 34 by the application of heat and pressure from a sealing jaw or jaws (not shown). The flange 16 could be provided on its surface adjacent to the web or film 34 with material to facilitate the attachment of the flange to the web or film.

Although the invention has been described above in relation to a particular design of zipper, it is to be understood that the invention is not to be regarded as limited to this particular design of zipper, but can be applied to zippers of other designs and having other configurations.

The invention claimed is:

1. A separable and reclosable fastener comprising a separable and reclosable male/female closure between a pair of opposed base members having interfitting male/female formations constituting the closure, wherein a single flange for attachment of the closure to a web or film extends laterally from only one of the two base members, and wherein each base member is provided with one single pair of ribs, one rib of each pair being positioned at a respective margin of the respective base member, the ribs being arranged to attach the fastener additionally to the web or film.

2. A reclosable fastener as claimed claim 1, in which a layer of sealant material is co-extruded onto each rib.

* * * * *

UNITED STATES PATENT AND TRADEMARK OFFICE

CERTIFICATE OF CORRECTION

PATENT NO. : 7,249,400 B2
APPLICATION NO. : 10/070937
DATED : July 31, 2007
INVENTOR(S) : Martin John Charles Offa-Jones It is certified that error appears in the above-identified patent and that said Letters Patent is hereby corrected as shown below:

Title page, change "(73) Assignee: Supreme Plastics Holding Ltd., London (GB)" to --(73) Assignee: Illinois Tool Works Inc., Glenview, IL--

Signed and Sealed this

Twenty-fourth Day of November, 2009

David J. Kappos

David J. Kappos
*Director of the United States Patent and Trademark Office*